US007722039B2

(12) United States Patent
Shoji et al.

(10) Patent No.: US 7,722,039 B2
(45) Date of Patent: May 25, 2010

(54) SHEET CONVEYING DEVICE AND IMAGE FORMING APPARATUS

(75) Inventors: Yutaka Shoji, Ibaraki-Pref (JP); Junji Shirakawa, Ibaraki-Pref (JP); Takayuki Muneyasu, Ibaraki-Pref (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 12/150,000

(22) Filed: May 12, 2008

(65) Prior Publication Data

US 2008/0296828 A1 Dec. 4, 2008

(30) Foreign Application Priority Data

May 31, 2007 (JP) ..... 2007-145395

(51) Int. Cl.
*B65H 5/02* (2006.01)

(52) U.S. Cl. ..... 271/273; 271/228; 271/229; 271/245; 271/246

(58) Field of Classification Search ..... 271/226–229, 271/242, 245–247, 273, 274; 399/395; 400/579, 400/630–632.1
See application file for complete search history.

(56) References Cited

U.S. PATENT DOCUMENTS 1,424,260 A * 8/1922 Richards ..... 271/246
2,693,357 A * 11/1954 Davidson ..... 271/246
2,984,482 A * 5/1961 Kist et al. ..... 271/231
3,630,519 A * 12/1971 Spear, Jr. ..... 271/246
3,716,228 A * 2/1973 Bottcher ..... 271/246
3,988,019 A * 10/1976 Achelpohl ..... 271/180
4,257,586 A * 3/1981 Weisbach ..... 271/235
4,645,195 A * 2/1987 Scranton et al. ..... 271/245
4,750,853 A * 6/1988 Van Soest et al. ..... 414/789.9
5,026,044 A * 6/1991 Ryon et al. ..... 271/227
5,072,923 A * 12/1991 Coy ..... 271/110
5,080,347 A * 1/1992 Funada ..... 271/266
5,154,412 A * 10/1992 Iseda ..... 271/227
5,356,263 A * 10/1994 Miller ..... 414/790.7
5,496,024 A * 3/1996 Luethi et al. ..... 271/273
5,673,911 A * 10/1997 Loftus et al. ..... 271/273
5,918,876 A * 7/1999 Maruyama et al. ..... 271/228

(Continued)

FOREIGN PATENT DOCUMENTS

JP 03-009373 1/1991

(Continued)

OTHER PUBLICATIONS

English Language Abstract of JP 03-094275 dated Apr. 19, 1991.

*Primary Examiner*—Patrick Mackey
*Assistant Examiner*—Jeremy Severson
(74) *Attorney, Agent, or Firm*—Harness, Dickey & Pierce, P.L.C.

(57) ABSTRACT

A cam unit includes three cams fixed on a common cam shaft for moving a pair of feeding rollers, a pair of lateral registration rollers, and a stopper unit, respectively. A control unit corrects a lateral registration of a sheet whose skew is corrected by the stopper unit, based on a detection result of a detecting unit that detects a position of a side edge of the sheet, while conveying the sheet, controls the rollers not nip the sheet at least during the lateral registration, and controls rotations of the cams according to a length of the sheet.

10 Claims, 8 Drawing Sheets

U.S. PATENT DOCUMENTS

| | | | | |
|---|---|---|---|---|
| 6,308,949 | B1 * | 10/2001 | Ito et al. | 271/251 |
| 6,343,787 | B1 * | 2/2002 | Kato et al. | 271/274 |
| 7,325,802 | B2 * | 2/2008 | Asakawa et al. | 271/273 |
| 7,384,043 | B2 * | 6/2008 | Giese | 271/273 |
| 7,467,793 | B2 * | 12/2008 | Tanabe | 271/245 |
| 2007/0069456 | A1 * | 3/2007 | Jeong | 271/272 |
| 2008/0251998 | A1 * | 10/2008 | Muneyasu et al. | 271/227 |

FOREIGN PATENT DOCUMENTS

| | | |
|---|---|---|
| JP | 10-203690 | 8/1998 |
| JP | 2893540 | 3/1999 |
| JP | 2008-050069 | 3/2008 |

* cited by examiner

SHEET CONVEYING DEVICE AND IMAGE FORMING APPARATUS

CROSS-REFERENCE TO RELATED APPLICATIONS

The present application claims priority to and incorporates by reference the entire contents of Japanese priority document 2007-145395 filed in Japan on May 31, 2007.

BACKGROUND OF THE INVENTION

1. Field of the Invention

The present invention relates to a sheet conveying device and an image forming apparatus, and more particularly, to a mechanism for performing a position correction in a main-scanning direction and a skew correction at a leading edge of a sheet.

2. Description of the Related Art

An image forming apparatus such as a laser printer feeds sheets such as printing papers accommodated in a feeding unit one by one, transfers a toner image formed on a photosensitive drum, a photosensitive belt, or the like onto the sheet at a transfer position, and fixes the toner image to the sheet, thereby obtaining the sheet with the toner image thereon.

In such image forming apparatus, a registration mechanism including a stopper and rollers is arranged just before the transfer position to correct the direction of the sheet, so that the toner image can be transferred at an appropriate position on the sheet.

For example, in Japanese Patent No. 2893540, the image forming apparatus includes a sheet conveying device. In the sheet conveying device, a stopper for positioning a sheet in a direction orthogonal to a sheet conveying direction is provided on a conveying path, and a leading end of the sheet is brought into contact with the stopper, so that the sheet is stopped. In this state, the sheet is fed by a conveying unit on the upstream side, and the stopper is released after a loop is formed in the sheet, so that the sheet is nipped and conveyed by a pair of rollers downstream of the stopper. Thereafter, a detecting unit that is arranged downstream of the stopper detects a side edge of the sheet, and a roller moving unit moves the rollers in a direction orthogonal to the sheet conveying direction to correct the position of the sheet so that the side edge of the sheet is aligned with a reference position.

FIG. 9 is a schematic diagram of a conventional sheet conveying device that includes a pair of lateral registration rollers 32, a stopper 33, a pair of feeding rollers 34, a sheet edge detection sensor 35, pairs of conveying rollers 36, sheet conveying paths 37 and 38, and sheet trays 40 and 41.

The stopper 33 is arranged just upstream of the lateral registration rollers 32, and can move between a sheet-conveying-path closed position and a sheet-conveying-path opened position. The distance between the lateral registration rollers 32 and the feeding rollers 34 in the sheet conveying path is shorter than a small-size sheet for enabling them to convey the small-size sheet, and the sheet conveying path upstream of the feeding rollers 34 includes the sheet conveying path 38 connected to the sheet tray 40 arranged in the apparatus body and the sheet conveying path 37 connected to the sheet tray 41 arranged outside the apparatus body. The pairs of conveying rollers 36 are arranged along the sheet conveying paths 37 and 38 for conveying the sheet to the feeding rollers 34. Moreover, the sheet conveying paths 37 and 38 are joined at a sheet-conveying-path junction point D upstream of the feeding rollers 34.

The operations of a sheet conveying position correction and a sheet skew correction in the above sheet conveying device are explained.

A sheet 39 conveyed by the feeding rollers 34 is stopped after the leading end thereof comes into contact with the stopper 33 that is set to the sheet-conveying-path closed position in advance. At this time, because the leading end of the sheet 39 is aligned with the stopper 33, the sheet skew correction is finished. Thereafter, the sheet 39 is fed by the feeding rollers 34 for a while until a buffer C is formed in the sheet 39 between the stopper 33 and the feeding rollers 34. Then, the stopper 33 is lowered to release the leading end of the sheet 39. In this state, due to the stiffness of the sheet 39 at the buffer C, the leading end of the sheet 39 is pushed into the nip portion of the lateral registration rollers 32. At this time, the nipping by the feeding rollers 34 is released, and the edge (side edge) of the sheet 39 in a main scanning direction is detected by the sheet edge detection sensor 35. After the correction amount of the sheet 39 in the main scanning direction is calculated, the lateral registration rollers 32 are moved laterally in an axis direction of the lateral registration rollers 32 by the correction amount, thereby aligning the position of the sheet 39 in the main scanning direction without the feeding rollers 34 affecting the operation of the sheet position correction (lateral registration).

When the sheet conveying position correction and the sheet skew correction are performed for a sheet having a length longer than the distance between the lateral registration rollers 32 and the conveying rollers 36 in the above sheet conveying device, if the conveying rollers 36 nip (press and hold) the trailing end of the sheet even after the leading end of the sheet is pushed into the nip portion of the lateral registration rollers 32, the sheet may be skewed to wrinkle or the sheet whose skew has been corrected by the stopper 33 may be skewed again due to the resistance at the nip portion between the conveying rollers 36 at the time of laterally moving the sheet with the lateral registration rollers 32 for the sheet conveying position correction. Therefore, when the sheet conveying position correction is performed, the conveying rollers 36 are released.

At the time when the stopper 33 is lowered to release the leading end of the sheet after forming the buffer C in the sheet between the stopper 33 and the feeding rollers 34, if the sheet is curled or has a low stiffness, the sheet may be buckled or skewed before being nipped by the lateral registration rollers 32, thereby misaligning the direction of the sheet or causing a jam of the sheet. On the contrary, if the sheet has a high stiffness, the sheet whose skew has been corrected by the stopper 33 may be skewed again and pushed into the nip portion of the lateral registration rollers 32 in this state, which indicates that the skew correction by the stopper 33 has no meaning. To solve this problem, the stopper 33 is arranged downstream of the lateral registration rollers 32 (see, for example, Japanese Patent Application Laid-open No. H10-203690).

In addition, with the above configuration, because the stopper and the conveying unit each need a driving unit, the apparatus itself becomes large and the manufacturing cost thereof becomes high.

Even if the above problems are solved, in the case of conveying the sheet that is thick, stiff, and has a length longer than the distance between the lateral registration rollers 32 and the sheet-conveying-path junction point D, if the radius of curvature of the sheet conveying path 38 from each sheet tray to the feeding rollers 34 is too small, the rear end portion of the sheet remaining on the sheet conveying path receives high resistance in conveying on the sheet conveying path. Consequently, when the sheet conveying position correction of the sheet 39 is performed in the main scanning direction by the lateral registration rollers 32, the resistance on the sheet conveying path interferes with the movement of the sheet 39 in the main scanning direction, which results in lowering the accuracy of aligning a sheet in conveying.

In the conventional sheet conveying device in FIG. 9, for performing the sheet skew correction by making the leading end of the sheet in contact with the stopper 33 and the sheet conveying position correction in the main scanning direction by the lateral registration rollers 32, it is necessary to associate the open/close timing of the conveying path by the stopper 33 and the nipping timing of the sheet by the lateral registration rollers 32 and the conveying rollers 36 with each other. That is, as described above, if the conveying rollers 36 nip the trailing end of the sheet after the leading end of the sheet is pushed into the nip portion of the lateral registration rollers 32, the sheet may be skewed to wrinkle or the sheet whose skew has been corrected by the stopper 33 may be again due to the resistance at the nip portion between the conveying rollers 36 at the time of performing the sheet position correction in main scanning direction by laterally moving the lateral registration rollers 32. Therefore, there is considered a configuration for operating each member at constant timing, in which a plurality of cams is provided on the same cam shaft to prevent a size increase of the apparatus, and the open/close timing and the nipping timing by the members are defined by rotating the cam shaft at a constant speed.

However, when the cams defining the timing of the members are used, the opening/closing operation and the nipping operation are performed by the members at constant timing based on the constant rotation speed of the cam shaft. Therefore, if there are various types of sheets with different lengths, unnecessary time loss is generated in conveying depending upon the length of the sheet, which may lower the conveying efficiency.

Specifically, in the above sheet aligning unit, in the case of performing the sheet skew correction and the lateral registration of the sheet while conveying the sheet at constant timing, the sheet aligning unit is control to operate normally for a sheet having the maximum length in the sheet conveying direction available for the sheet aligning unit. For example, if the sheet aligning unit is used in the image forming apparatus in which an A4 size sheet is available at the maximum length, because there are not so many types of sheets having a length shorter than the A4 size sheet used, the sheet aligning unit can be easily controlled by causing it to operate at constant timing corresponding to the length of the A4 size sheet.

However, in practice, there are many types of sheets having different lengths available. If the difference in length between longer and shorter sheets is large, the shorter sheet is controlled to be conveyed at the same timing as that for the longer sheet. Therefore, for example, the feeding rollers that nip and convey the trailing end of the sheet come into contact with each other again at the timing for the longer sheet even when conveying the shorter sheet. Therefore, the waiting time in the case of the shorter sheet becomes long compared to the case of the longer sheet, thereby causing a time loss.

SUMMARY OF THE INVENTION

It is an object of the present invention to at least partially solve the problems in the conventional technology.

According to an aspect of the present invention, there is provided a sheet conveying device including a sheet conveying path along which the sheet is conveyed; at least one pair of conveying rollers, a pair of feeding rollers, a pair of lateral registration rollers, a stopper unit that stops a leading end of the sheet conveyed along the sheet conveying path to correct a skew of the sheet, and a detecting unit that detects a position of a side edge of the sheet, arranged on the sheet conveying path in order from an upstream of the sheet conveying path; a cam unit including three cams fixed on a common cam shaft for moving the feeding rollers, the lateral registration rollers, and the stopper unit, respectively; and a control unit that controls rotations of the cams. The control unit corrects a lateral registration of the sheet based on a detection result of the detecting unit while conveying the sheet of which the skew is corrected by the stopper unit, controls the conveying rollers, the feeding rollers, the lateral registration rollers not nip the sheet at least during the lateral registration, and controls the rotations of the cams according to a length of the sheet.

Furthermore, according to another aspect of the present invention, there is provided an image forming apparatus including a sheet conveying device that includes a sheet conveying path along which the sheet is conveyed; at least one pair of conveying rollers, a pair of feeding rollers, a pair of lateral registration rollers, a stopper unit that stops a leading end of the sheet conveyed along the sheet conveying path to correct a skew of the sheet, and a detecting unit that detects a position of a side edge of the sheet, arranged on the sheet conveying path in order from an upstream of the sheet conveying path; a cam unit including three cams fixed on a common cam shaft for moving the feeding rollers, the lateral registration rollers, and the stopper unit, respectively; and a control unit that controls rotations of the cams. The control unit corrects a lateral registration of the sheet based on a detection result of the detecting unit while conveying the sheet of which the skew is corrected by the stopper unit, controls the conveying rollers, the feeding rollers, the lateral registration rollers not nip the sheet at least during the lateral registration, and controls the rotations of the cams according to a length of the sheet.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained below with reference to the accompanying drawings.

Figure 1:
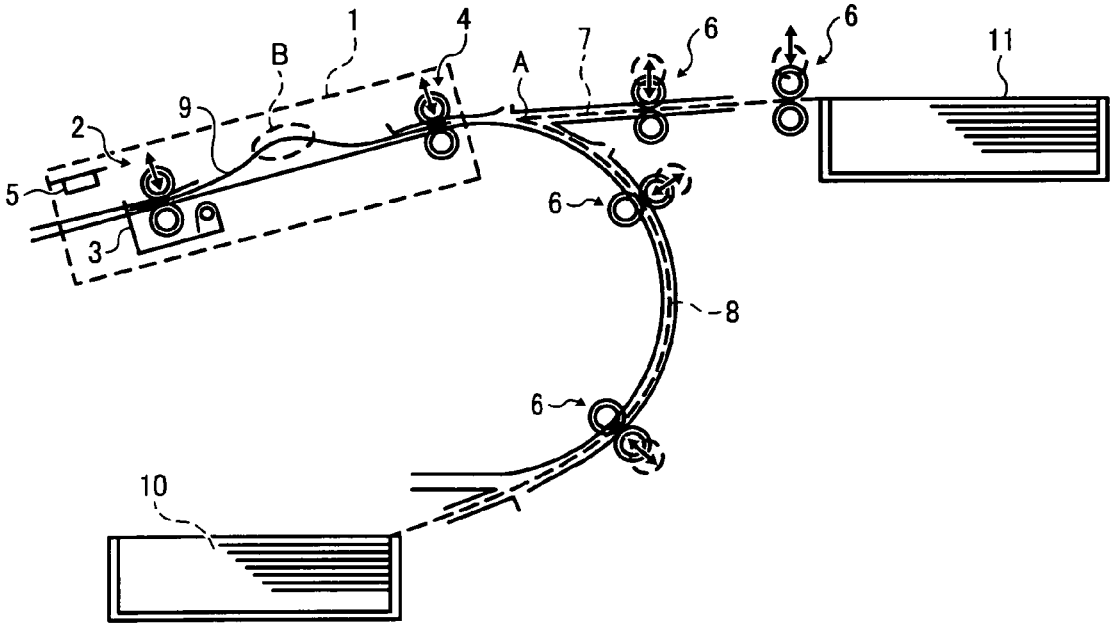
FIG. 1 is a schematic diagram of one example of a sheet conveying device according to an embodiment of the present invention.

FIG. 1 is a schematic diagram of one example of a sheet conveying device according to an embodiment of the present invention. The sheet conveying device includes a sheet aligning unit 1 including a pair of lateral registration rollers 2 as a first pair of rollers, a stopper 3 including a claw at its one end, a pair of feeding rollers 4 as a second pair of rollers, and a detection sensor 5, pairs of conveying rollers 6 as third pairs of rollers, a straight sheet-conveying path 7, a curved sheet-conveying path 8, and sheet trays 10 and 11.

Sheets 9 in the sheet tray 10 arranged outside the apparatus body and the sheet tray 11 arranged in the apparatus body are conveyed to the feeding rollers 4 through the sheet-conveying paths 7 and 8, respectively, by the conveying rollers 6 provided on the sheet-conveying paths 7 and 8. The distance between adjacent pairs of the conveying rollers 6 is about 150 millimeters to 180 millimeters for enabling them to convey a small-size sheet. In each pair of the conveying rollers 6, one of the rollers is a driving roller, and the other one is a driven roller. The driving roller and the driven roller can be separated from each other. The sheet-conveying paths 7 and 8 are joined at a sheet-conveying-path junction point A upstream of the feeding rollers 4.

The detection sensor 5 is, for example, a contact image sensor (CIS) or a charged coupled device (CCD) linear sensor, and detects a side edge of the sheet 9. The conveying path between the lateral registration rollers 2 and the feeding rollers 4 has a substantially straight shape with a length of 100 millimeters to 180 millimeters for conveying a small-size sheet. The stopper 3 is arranged just downstream of the lateral registration rollers 2, which is different from the conventional technologies. The stopper 3 can switch its position between a sheet-conveying-path opened position and a sheet-conveying-path closed position.

The operations of a sheet conveying position correction and a sheet skew correction in the sheet aligning unit 1 are explained. The lateral registration rollers 2 are separated before the leading end of the sheet 9 reaches the lateral registration rollers 2, and the claw of the stopper 3 is raised to the sheet-conveying-path closed position. Just before the leading end of the sheet 9 comes into contact with the claw, the feeding rollers 4 decrease its conveying speed of the sheet 9 and presses the sheet 9 to the stopper 3 while nipping it. With this operation, a buffer B is formed in the sheet 9 between the stopper 3 and the feeding rollers 4, and the leading end of the sheet 9 is aligned with the claw, thereby correcting the skew of the sheet 9. Thereafter, the sheet 9 is nipped by the lateral registration rollers 2. In the following explanation, the CCD image linear sensor is used as the detection sensor 5.

The stopper 3 is lowered to release the leading end of the sheet 9, and the sheet 9 is conveyed by the lateral registration rollers 2 in a state where the feeding rollers 4 are separated. When the sheet 9 reaches the detection sensor 5, the detection sensor 5 detects the position of the side edge of the sheet 9 in a main scanning direction, and a control unit 1000 calculates a correction amount of the sheet 9 in the main scanning direction.

The control unit 1000 laterally moves the lateral registration rollers 2 in a roller axis direction by the calculated correction amount to align the position of the sheet 9 in the main scanning direction, thereby finishing the position correction of the sheet. During the lateral movement, the lateral registration rollers 2 keep its rotation to convey the sheet 9, so that the sheet 9 can be conveyed with minimum loss of time.

Thereafter, when the sheet 9 is nipped by a conveying unit such as a transfer unit (not shown) including rollers and the like downstream of the lateral registration rollers 2, the lateral registration rollers 2 are separated again to return to its home position.

Upon performing the sheet aligning operation, in the case where a sheet to be conveyed has a length longer than the distance between the stopper 3 and the pair of the conveying rollers 6 closest to the sheet-conveying-path junction point A, the control unit 1000 controls the pairs of the conveying rollers 6 so that at least the rollers between which the sheet 9 is present are separated at the time when the sheet 9 reaches the stopper 3.

In the sheet aligning operation by the sheet conveying device configured in such manner, when the lateral registration rollers 2 are laterally moved in the roller axis direction, only the lateral registration rollers 2 nip the sheet 9 regardless of the length of the sheet 9. Therefore, the resistance which the sheet 9 receives on the upstream of the lateral registration rollers 2 is only the friction resistance between the sheet 9 and the sheet conveying path. Because the sheet conveying path of the sheet aligning unit 1 has a straight shape, the resistance which the sheet 9 receives during alignment of the sheet conveying position by the lateral registration rollers 2 can be suppressed small. Therefore, when the lateral registration rollers 2 are moved laterally, the force of nipping the sheet 9 by the lateral registration rollers 2 is much larger than the resistance which the sheet 9 receives on the upstream of the lateral registration rollers 2. Thus, it is prevented that the sheet 9 whose skew has been corrected by the stopper 3 is skewed to wrinkle or skewed again due to the resistance on the upstream of the lateral registration rollers 2, enabling the sheet aligning unit 1 to achieve high accuracy of aligning a sheet in conveying.

Figure 2A:
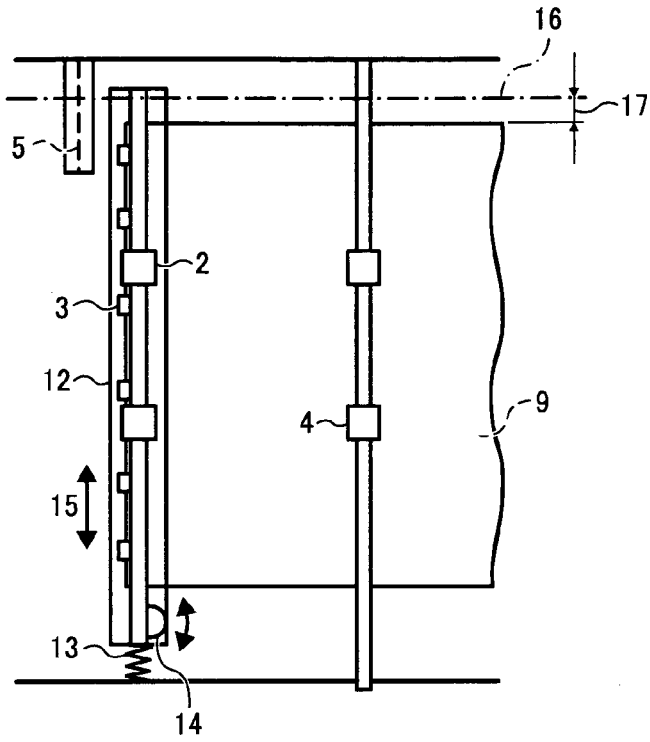
FIGS. 2A to 2C are plan views showing a configuration of a sheet aligning unit in the sheet conveying device shown in FIG. 1.
Figure 2B:
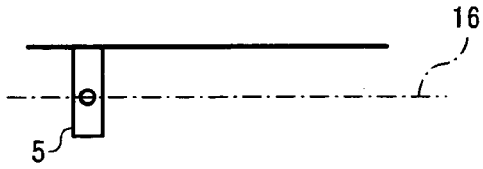
Figure 2C:
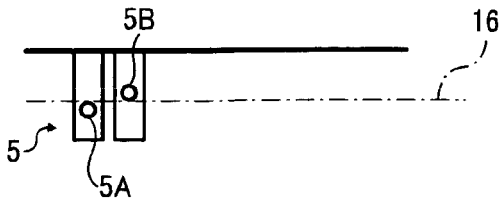

FIGS. 2A to 2C are plan views showing a configuration of the sheet aligning unit 1, in which a linear sensor is used as the detection sensor 5 in FIG. 2A, a photocoupler is used as the detection sensor 5 in FIG. 2B, and two photocouplers are used as the detection sensor 5 in FIG. 2C as examples. In FIGS. 2B and 2C, only part of the sheet aligning unit 1 is shown.

As shown in FIG. 2A, the detection sensor 5 is arranged downstream of the stopper 3, and the lateral registration rollers 2 are attached to a unit frame 12 so that the lateral registration rollers 2 are movable in its axis direction by a lateral moving unit including the unit frame 12, a spring 13, a cam 14 having its rotation axis on the apparatus body side, and a drive source (not shown) for driving the cam 14 to rotate.

The unit frame 12 is normally pressed to the cam 14 by the spring 13, and is movable in a direction orthogonal to the sheet conveying direction as indicated by a left right arrow 15 in FIG. 2A (i.e., the axis direction of the lateral registration rollers 2) by rotating the cam 14.

When it is found by the detection sensor 5 that the side edge of the sheet 9 is misaligned by a misalignment amount 17 from a predetermined reference position 16, a correction amount corresponding to the misalignment amount 17 is given by rotating the cam 14 so that the sheet side edge is aligned with the reference position 16.

As described above, the configuration of controlling the open/close operations of the conveying path and the contact/separation operations of pairs of rollers targeting a plurality of members such as the lateral registration rollers 2, the stopper 3, and the feeding rollers 4 by using the cam 14 arranged on the same shaft is advantageous in reducing the size of a mechanism needed for the operation control and the manufacturing cost by decreasing the number of parts, which is disclosed in Japanese Patent Application No. 2006-225253.

When a linear image sensor including a CCD array is used as the detection sensor 5 as shown in FIG. 2A, the misalignment amount 17 of the sheet side edge from the reference position 16 can be easily measured only by using the conventional technology. The misalignment amount 17 is converted into the rotation amount of the cam 14 to be given as the correction amount to the cam 14. Although the measured value is output as a discrete value regarding the length, there is no problem so long as the length corresponding to a pixel with one bit in the CCD array (the distance in a misalignment direction of the sheet side edge) is within an allowable tolerance in sheet alignment.

When a simple photocoupler detecting one point is used as the detection sensor 5 as shown in FIG. 2B, the misalignment amount cannot be directly calculated; however, the direction of the misalignment can be recognized. Therefore, the output of the photocoupler is fed back directly to the control unit that controls the cam 14, thereby controlling the lateral position of the sheet 9.

The controlling method of the cam 14 is explained.

When the light flux is blocked by the sheet 9 so that there is no signal output from the photocoupler (a first case), the sheet 9 is laterally moved in a direction in which the photocoupler outputs a signal (a direction toward a center of the sheet 9) and is stopped at the position where the photocoupler starts to output a signal. On the contrary, when the light flux is not blocked by the sheet 9 (a second case), the sheet 9 is laterally moved in a direction opposite to the above until the photocoupler stops outputting a signal. However, in such manner, the stop position of the sheet 9 may not be the same as that in the first case, and there may be a big difference between both stop positions. Therefore, after the output of a signal from the photocoupler is stopped, the sheet 9 is moved again in the direction in which the photocoupler outputs a signal, and the sheet 9 is stopped when the photocoupler starts to output a signal. With this method, the difference in the stop positions depends only upon the difference in stopping the motor for rotating the cam 14 and the difference in transmitting the driving force of the motor to the cam 14. Adversely, a method can also be adapted, in which the stop position is determined in both first and second cases at the time when the output of a signal is stopped. Any method can be employed according to the design.

The position of the cam 14 at which the lateral moving amount of the lateral registration rollers 2 is the minimum when the sheet 9 is sent in a state where the side edge is aligned with the reference position 16 is set as a home position. The control unit controls the cam 14 so that the cam 14 is normally placed at the home position. After the cam 14 rotates to laterally move the lateral registration rollers 2 and finishes its role, the control unit returns the cam 14 to its original position, that is, the home position.

Alternatively, two photocouplers 5A and 5B can be used as the detection sensor 5. The photocouplers 5A and 5B are arranged so that the detection positions thereof are on the opposite sides of the reference position 16. The interval between the detection positions is set to about an allowable tolerance of the lateral registration.

For example, in the case where the photocoupler 5A is arranged on the center side of the sheet with respect to the reference position 16, when the photocoupler 5A does not output a signal because the light flux is blocked by the sheet 9 and the photocoupler 5B outputs a signal, it indicates that the side edge of the sheet 9 is placed at a desired position. Therefore, when both or none of the photocouplers 5A and 5B output a signal, the sheet 9 is laterally misaligned. To correct the misalignment, the sheet 9 is laterally moved until the photocoupler 5A stops outputting a signal in the former case, and until the photocoupler 5B starts to output a signal in the latter case.

Figure 3:
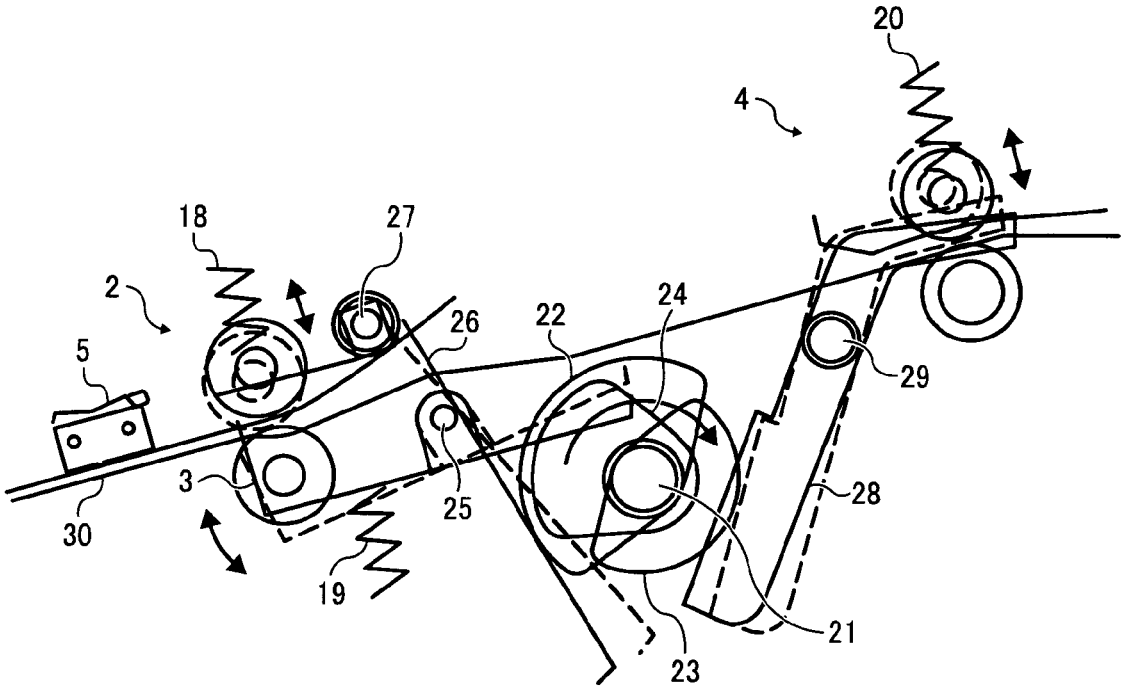
FIG. 3 is a side view of a relevant part of the sheet aligning unit.

FIG. 3 is a side view of a relevant part of the sheet aligning unit that includes springs 18, 19, and 20, a cam shaft 21, cams 22, 23, and 24, a support shaft 25 of the stopper 3, a retract arm 26 that makes the lateral registration rollers 2 in contact with or separated from each other, a support shaft 27 of the retract arm 26, a retract arm 28 that makes the feeding rollers 4 in contact with or separated from each other, a support shaft 29 of the retract arm 28, and a sheet conveying path 30.

The stopper 3 can rotate around the support shaft 25, and project into the sheet conveying path 30 by the spring 19. Moreover, the stopper 3 can make the sheet conveying path 30 in the opened state by the action of the cam 23.

The sheet aligning unit 1 includes a first conveying unit and a second conveying unit in its relevant part. The first conveying unit includes the lateral registration rollers 2, and a driving mechanism and a contact/separation mechanism of the lateral registration rollers 2. The second conveying unit includes the feeding rollers 4, and a driving mechanism and a contact/separation mechanism of the feeding rollers 4.

The lateral registration rollers 2 are arranged upstream of the stopper 3, and are in pressure-contact with each other by the spring 18. The lateral registration rollers 2 can be separated from each other by the cam 22 pushing up the retract arm 26 that is rotatably attached to the support shaft 27. In the similar manner, the feeding rollers 4 are in pressure-contact with each other by the spring 20, and can be separated from each other by the cam 24 pushing up the retract arm 28 that is rotatably attached to the support shaft 29. With the rotation of the cam shaft 21 by a given angle, the cams 22, 23, and 24 fixed on the cam shaft 21 can perform combination of the operations of the contact/separation of the lateral registration rollers 2, the opening/closing of the sheet conveying path 30 by the stopper 3, and the contact/separation of the feeding rollers 4.

Figure 4A:
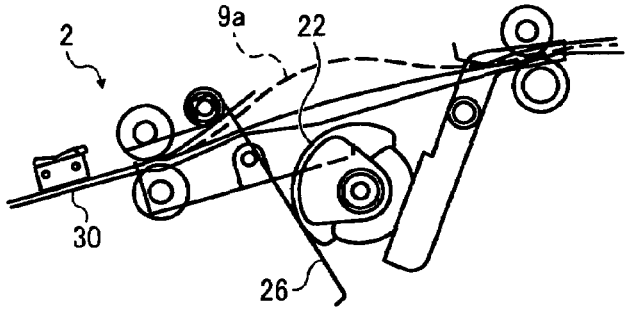
FIGS. 4A to 4E are schematic diagrams for explaining operations of the sheet aligning unit.
Figure 4B:
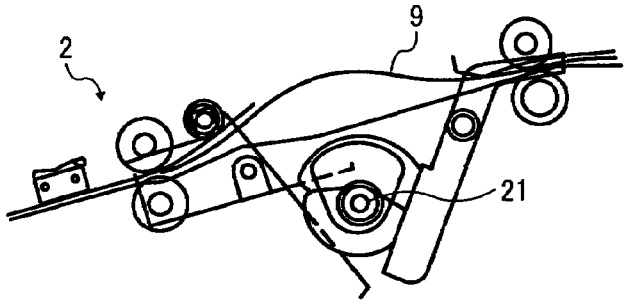
Figure 4C:
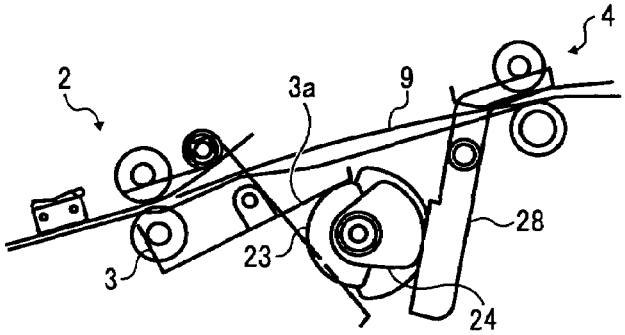
Figure 4D:
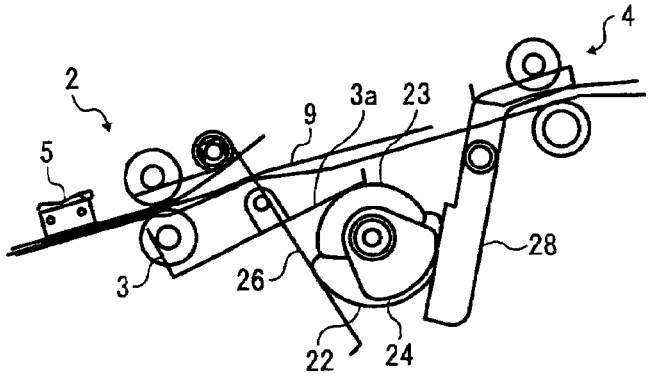
Figure 4E:
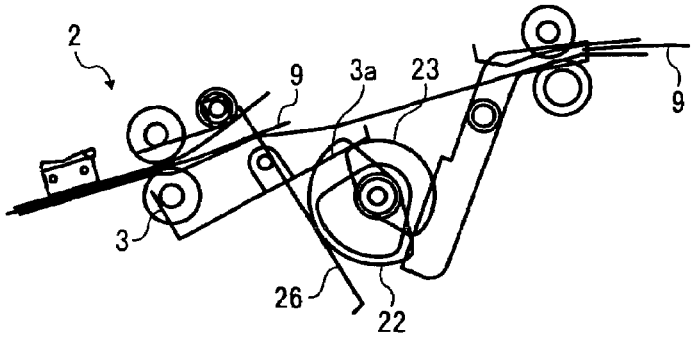

FIGS. 4A to 4E are schematic diagrams for explaining operations of the sheet aligning unit 1, in which the lateral registration rollers 2 are in the released (separated) state in FIG. 4A, all of the cams 22, 23, and 24 are not operated in FIG. 4B, the stopper 3 and the feeding rollers 4 are in the released state in FIG. 4C, the stopper 3, the feeding rollers 4, and the lateral registration rollers 2 are in the released state in FIG. 4D, and the lateral registration rollers 2 are in the released state in FIG. 4E.

Figure 5:
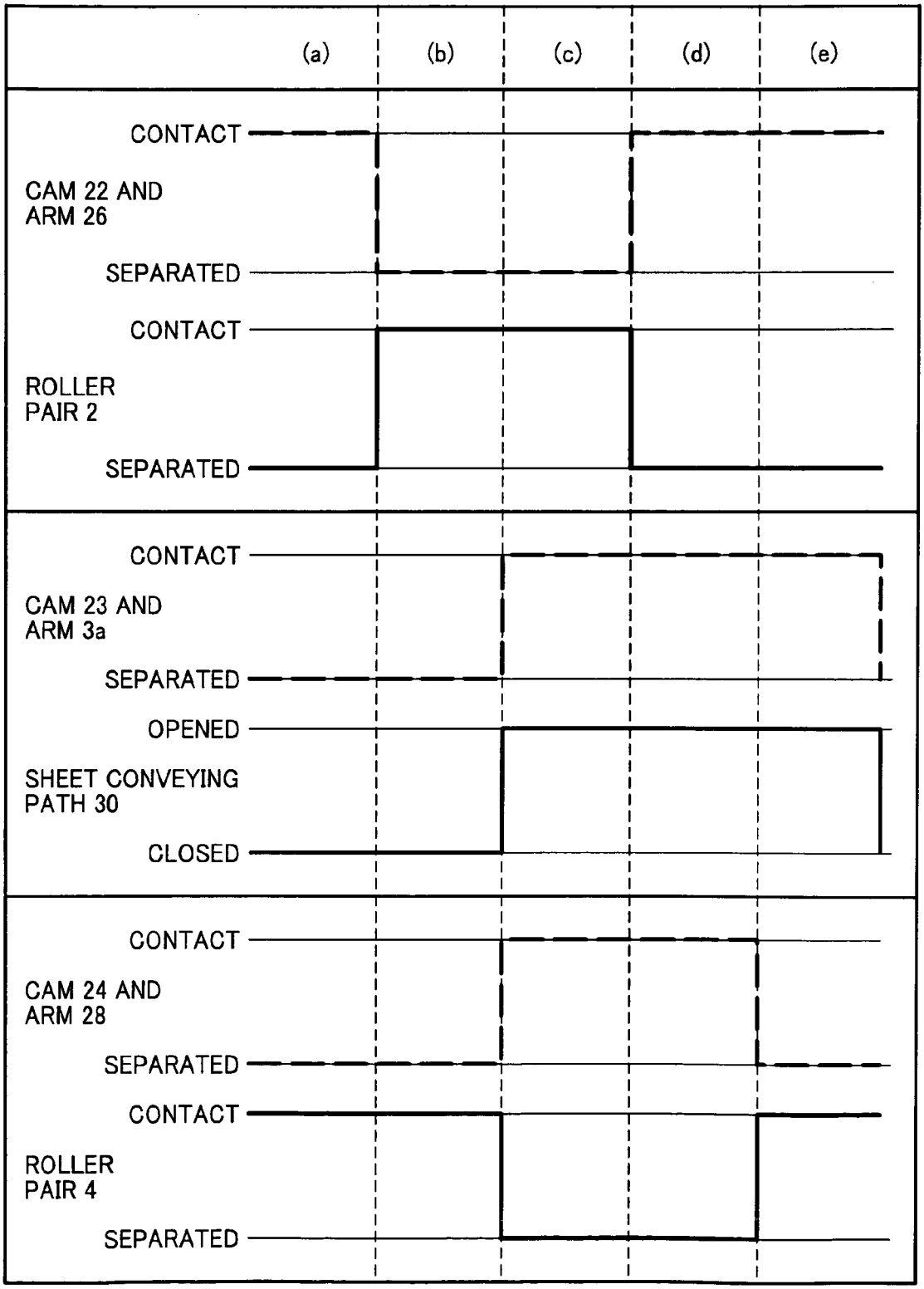
FIG. 5 is a timing chart for explaining operations of the sheet aligning unit.

FIG. 5 is a timing chart representing operations of the sheet aligning unit 1 shown in FIGS. 4A to 4E, in which heavy broken lines indicate the states of the cams 22, 23, and 24 with respect to the retract arm 26, an arm 3*a*, and the retract arm 28, respectively, and heavy solid lines indicate the operation states of the lateral registration rollers 2, the sheet conveying path 30, and the feeding rollers 4 corresponding to the states of the cams 22, 23, and 24, respectively. In FIG. 5, the term "contact" indicates that a large diameter portion in the cam profile of the cam is opposed to and in contact with the arm (in some cases, referred to as an operating state), and the term "separated" indicates that a small diameter portion in the cam profile of the cam is opposed to the arm while being separated therefrom (in some cases, referred to as a released state). Moreover, the term "opened" indicates that the sheet conveying path 30 is in the opened state, and the term "closed" indicates that the sheet conveying path 30 is in the closed state. Furthermore, although each of the regions (a) to (e) is depicted to have the same width in the lateral direction in FIG.

5 for convenience sake, the width does not correspond to the rotation angle of the cam shaft corresponding to each state.

The operations of the sheet aligning unit 1 shown in FIGS. 4A to 4E are explained referring to FIG. 5.

In FIG. 4A, the stopper 3 projects into the sheet conveying path 30, and the cam 22 is in contact with the retract arm 26 and pushes up the retract arm 26 against the force by the spring 18 thereby separating the lateral registration rollers 2. The feeding rollers 4 are in pressure-contact with each other while nipping the sheet 9 therebetween. The sheet 9 conveyed at a predetermined speed by the rotation of the feeding rollers 4 decreases its speed when the leading end thereof reaches just in front of the stopper 3, and comes into contact with the stopper 3. Furthermore, the sheet 9 is pushed in the sheet conveying direction by the feeding rollers 4, and the feeding rollers 4 are stopped in a state where a loop 9*a* is formed in the sheet 9. At this time, the leading end of the sheet 9 is into contact with the stopper 3 due to the force exerted by the loop 9*a*, so that the skew of the sheet 9 is corrected.

In the region (a) in FIG. 5, the cam 22 and the retract arm 26 are in the "contact" state, so that the lateral registration rollers 2 are in the "separated" state. Moreover, the cam 23 and the arm 3*a* are in the "separated" state, so that the sheet conveying path 30 is in the "closed" state. Furthermore, the cam 24 and the retract arm 28 are in the "separated" state, so that the feeding rollers 4 are in the "contact" state.

In FIG. 4B, with the rotation of the cam shaft 21, the cam 22 is separated from the retract arm 26, and the lateral registration rollers 2 come into pressure-contact with each other by the force of the spring 18. At this time, the sheet 9 is nipped between the lateral registration rollers 2 in a state where the skew is corrected by the stopper 3, and the cam 23 and the cam 24 are still not in contact with the arm 3*a* and the retract arm 28.

In the region (b) in FIG. 5, all of the cams 22, 23, and 24 are in the "separated" state, and the rollers and the arms corresponding to the cams 22, 23, and 24 are all in stable states due to the force of the springs 18, 19, and 20. Specifically, the lateral registration rollers 2 and the feeding rollers 4 are both in the "contact" state, and the sheet conveying path 30 is in the "closed" state by the claw of the stopper 3.

In FIG. 4C, with the further rotation of the cam shaft 21, the cam 23 comes into contact with the arm 3*a* that is on the opposite side of the claw with respect to the support shaft 25 of the stopper 3, thereby rotating the stopper 3 counterclockwise against the force of the spring 19. Consequently, the claw of the stopper 3 is retracted, so that the sheet conveying path 30 becomes the opened state. Moreover, the cam 24 comes into contact with the retract arm 28 to rotate the retract arm 28 counterclockwise against the force of the spring 20, so that the feeding rollers 4 are separated. In this state, the sheet 9 is conveyed by the lateral registration rollers 2. The side edge of the sheet 9 is detected by the detection sensor 5, and the lateral registration rollers 2 are moved in the direction as indicated by the left right arrow 15 by the cam 14 while nipping and conveying the sheet 9 by the misalignment amount 17 between the reference position 16 and the sheet side edge position so that the side edge of the sheet 9 coincides with the reference position 16.

In the region (c) in FIG. 5, only the lateral registration rollers 2 are in the "contact" state, and the feeding rollers 4 and the sheet conveying path 30 are both in the released state.

In FIG. 4D, after the sheet 9 reaches a conveying unit (not shown) or an image transfer unit (not shown) arranged downstream of the sheet aligning unit 1, the lateral registration rollers 2 are separated due to the action of the cam 22 by the rotation of the cam shaft 21. Thereafter, the lateral registration rollers 2 move in the direction opposite to the movement thereof in FIG. 4C, by the further rotation or the inverse rotation of the cam 14 to return to the home position. At this time, the lateral registration rollers 2 are still separated from each other, so that the conveyance of the sheet 9 is not affected by the lateral registration rollers 2 even if the middle portion of the sheet 9 is positioned between the lateral registration rollers 2.

In the region (d) in FIG. 5, the lateral registration rollers 2, the sheet conveying path 30, and the feeding rollers 4 are all in the released state. Specifically, the lateral registration rollers 2 and the feeding rollers 4 are both in the "separated" state, and the sheet conveying path 30 is in the "opened" state. In this state, the trailing end of the sheet 9 passes the feeding rollers 4.

In FIG. 4E, the feeding rollers 4 are in pressure-contact with each other due to the action of the cam 24 by the rotation of the cam shaft 21 before a sheet 9' that is conveyed next to the sheet 9 reaches the feeding rollers 4 to be ready for conveying the sheet 9'. Moreover, the cam 23 is rotated to release the contact with the arm 3*a* to cause the claw of the stopper 3 to project into the sheet conveying path 30 before the leading end of the sheet 9' reaches the stopper 3 after the trailing end of the sheet 9 passes the claw of the stopper 3 to return to the state shown in FIG. 4A. Therefore, the skew and the conveying position of the sheet 9' can also be corrected in the same manner.

In the region (e) in FIG. 5, the lateral registration rollers 2 in the "contact" state convey the sheet 9 while the sheet conveying path 30 is in the "opened" state, so that the sheet 9 is handed over to a conveying mechanism downstream of the sheet aligning unit 1. The sheet 9 has already passed the feeding rollers 4, so that the feeding rollers 4 come into the "contact" state to be ready for conveying the sheet 9'.

Figure 6:
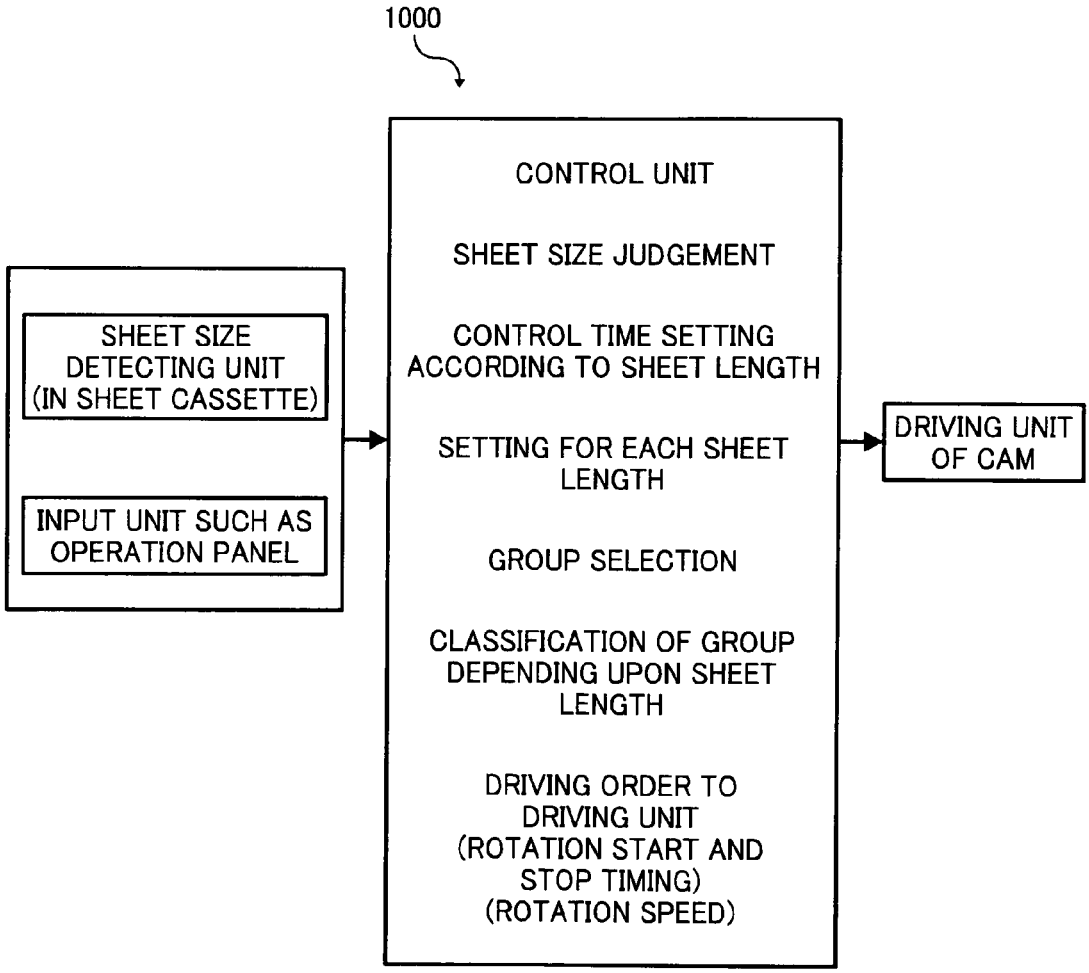
FIG. 6 is a schematic block diagram of a control system used in the sheet aligning unit.

The above operations of the cams 22, 23, and 24 for the open/close operation of the stopper 3, the contact/separation operations of the lateral registration rollers 2 and the feeding rollers 4 are controlled by the control system shown in FIG. 6.

FIG. 6 is a schematic block diagram of the control system. In FIG. 6, the control unit 1000 of the control system is used to execute an image forming sequence program, and is connected with a sheet size detecting unit and an input unit on the input side and a cam shaft drive source on the output side. The sheet size detecting unit detects the size of sheets accommodated in the sheet cassette, and the input unit is, for example, an operation panel for a user to manually specify the size of a sheet.

The control unit 1000 has functions as follows. In FIG. 6, contents of the control processes as follows are depicted for convenient sake.

Figure 7:
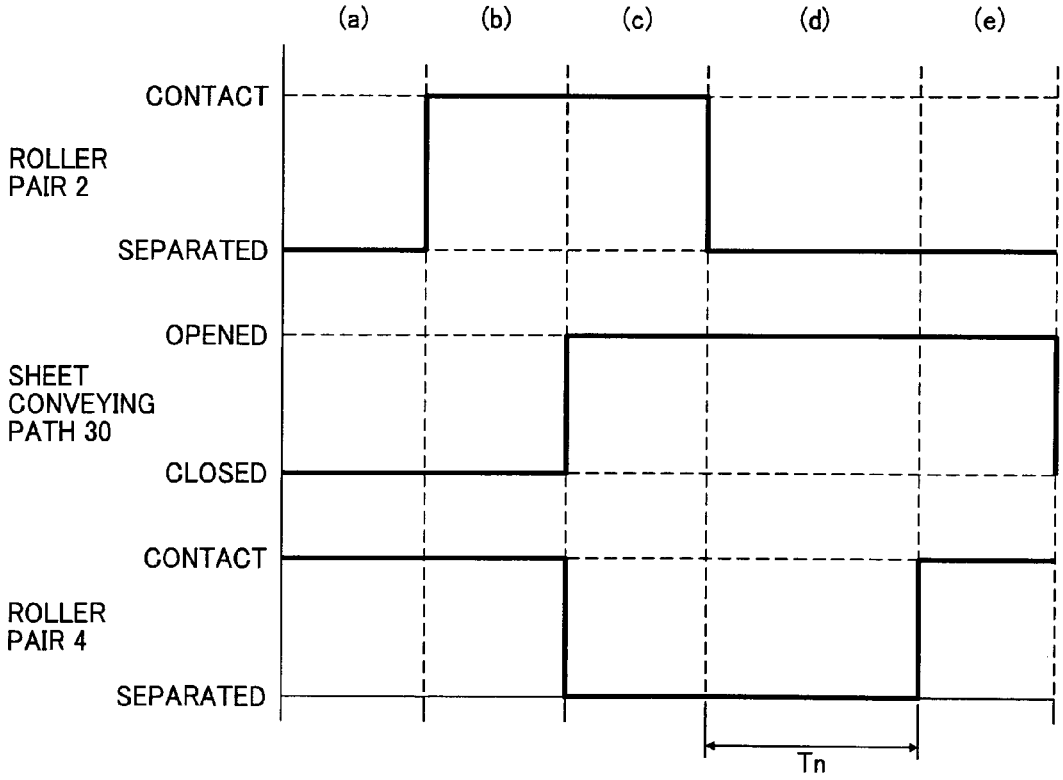
FIG. 7 is a timing chart for explaining operation conditions set by a control unit shown in FIG. 6.

(1) A time interval Tn is changed depending upon the length of the sheet. The time interval Tn is the time interval from the time the trailing end of the sheet passes the feeding rollers 4 that are in the separated state to the time the feeding rollers 4 come into the contact state again (FIG. 7). That is, even if the time at which the trailing end of the sheet passes the feeding rollers 4 is different depending upon the length of the sheet, the feeding rollers 4 are controlled to come into the contact state again based on the time when the trailing end of the sheet passes the feeding rollers 4 in each size of the sheet. Therefore, in the case of the sheet having a shorter length, the feeding rollers 4 come into contact with each other again earlier than the case of the sheet having the maximum length, so that the time for making the feeding rollers 4 come into contact with each other again can be shortened.

The time interval Tn is changed by setting the rotation timing and the stop timing of the cam shaft, especially the stop timing. The stop timing can be changed by changing the rotation speed of the cam shaft per minute. Specifically, the time to reach the stop timing is changed by changing the rotation speed of the cam shaft per minute, and the timing to make the feeding rollers come into contact with each other again is set corresponding to the change.

(2) The sheets are divided into a plurality of groups depending upon the length thereof, and the operation time for the maximum-length sheet in each group is set as the operation time for each group.

A table 1 shown below represents the case in which the sheets are divided into three groups (T1, T2, T3) depending upon the length of the sheets, and the sheet length and the standard size are shown for each group.

In the sheet conveying device according to the embodiment, the sheets from the minimum length of 140 millimeters to the maximum length of 490 millimeters are targeted and are divided into three groups.

TABLE 1

| Time Interval Tn | Length [mm] | Sample Sheet Size (Standard Size) |
|---|---|---|
| T1 | 140 to 250 | Postcard, A6T, A5T/Y, A4Y, B5Y, LTY |
| T2 | 251 to 370 | A4T, B4T, LTT, LGT |
| T3 | 371 to 490 | A3T, A3+ T, DLTT |

In the table 1, "T" indicates that a longer side of the sheet coincides with the sheet conveying direction (for example, the length of A6T (105×148 [$mm^2$]) sheet in the conveying direction is 148 millimeters), "Y" indicates that a shorter side of the sheet coincides with the sheet conveying direction (for example, the length of LTY (215.9×279.4 [$mm^2$]) sheet in the conveying direction is 215.9 millimeters), "LT" stands for a letter size of 215.9×279.4 [$mm^2$] (8.5×11 [$in^2$ (square inch)], "LG" stands for a legal size of 215.9×355.6 [$mm^2$] (8.5×14 [$in^2$]), "DLT" stands for a double letter size of 279.4×431.8 [$mm^2$] (11×17 [$in^2$]) (the length of DLTT sheet in the conveying direction is 431.8 millimeters), and A3+ T sheet has a size of 328×453 [$mm^2$] as one example (the size thereof differs depending upon the manufacturer).

In Table 1, sheets with a length in the range of 140 millimeters to 250 millimeters belong to T1, so that even a nonstandard size sheet is conveyed with the control operation time of T1 as long as the nonstandard size sheet has a length within the range of 140 millimeters to 250 millimeters. Therefore, even if the sheets have different lengths, the sheets within a length range of a preset group can be controlled uniformly, so that the process can be simplified compared to the case of calculating the control operation time for each sheet having a different length. Consequently, the contents of the control do not become complex, enabling to reduce cost and time for control design.

The control unit 1000 identifies a group of the sheet length based on the length of the designated sheet, and controls the rotation/stop operations and the rotation speed of the cams with the timing corresponding to the control operation time preset for the group.

According to the embodiment, the contact/separation timing of the feeding rollers 4 can be changed according to the length of the sheet, so that it is possible to prevent causing a waste of time depending upon the length of the sheet, thereby improving the conveying efficiency of the sheets. Moreover, the sheets are divided into a plurality of groups depending upon the length of the sheets, so that the control unit only controls the rotation of the cam shaft based on the maximum-length sheet in each group for each group, whereby it is prevented that the control becomes complex, resulting in simplifying the contents of the control.

Figure 8:
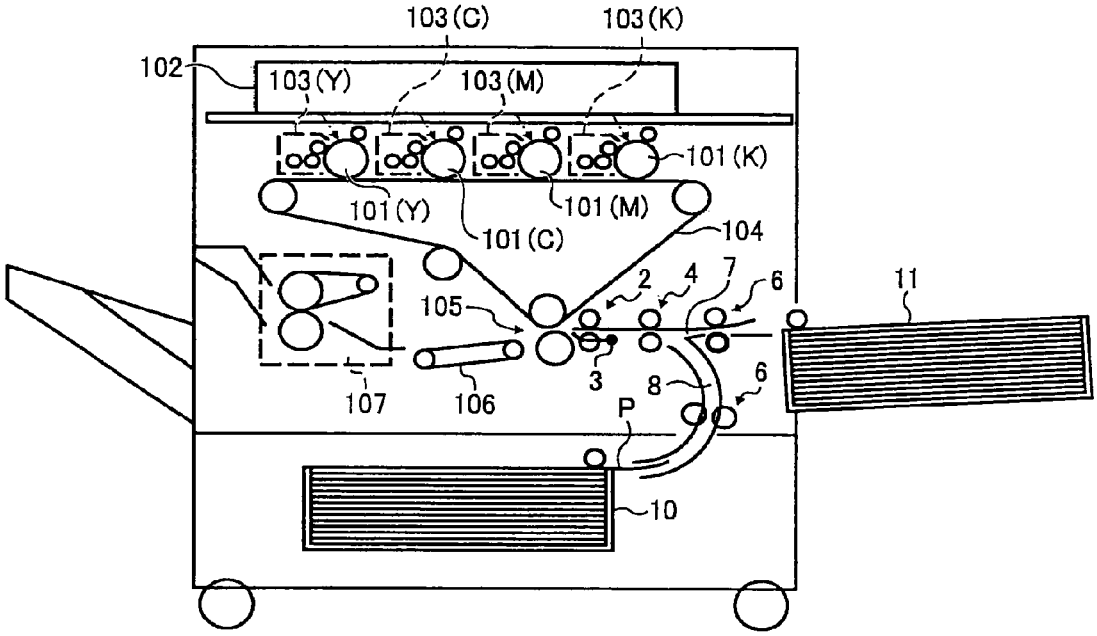
FIG. 8 is a schematic diagram of an image forming apparatus in which the sheet aligning unit is employed.
Figure 9:
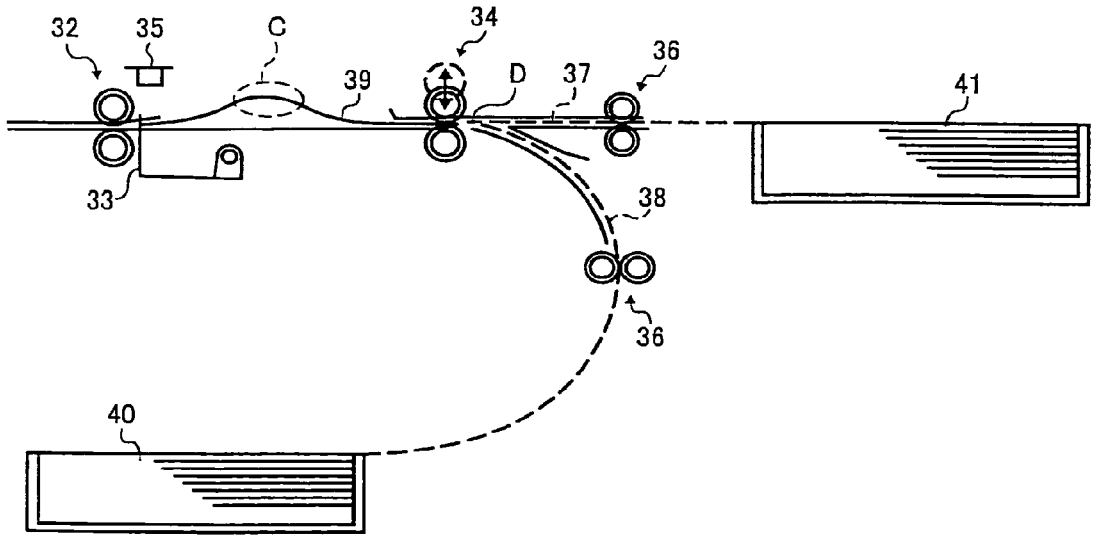
CONVENTIONAL ART FIG. 9
FIG. 9 is a schematic diagram of a conventional sheet conveying device.

FIG. 8 is a schematic diagram of an image forming apparatus including photosensitive elements 101 for yellow (Y), cyan (C), magenta (M), and black (B), an optical writing unit 102, developing units 103 for Y, C, M, and B, a transfer belt 104, a secondary transfer unit 105, a conveying unit 106, and a fixing unit 107.

A latent image is formed in each of the photosensitive elements 101 by the optical writing unit 102, and images developed by the developing units 103 are transferred onto the transfer belt 104.

A sheet P supplied from the sheet tray 10 reaches the feeding rollers 4 by the conveying rollers 6 provided in the middle of the curved sheet-conveying path 8, and is conveyed by the feeding rollers 4 until the leading end of the sheet P is in contact with the claw of the stopper 3 that projects into the sheet conveying path. When the sheet P is supplied from the sheet tray 11, the sheet P reaches the feeding rollers 4 by the conveying rollers 6 provided in the middle of the straight sheet-conveying path 7, and is conveyed by the feeding rollers 4 in the same manner.

At this time, the lateral registration rollers 2 are in the released state. After the skew of the sheet P is corrected by making the leading end the sheet P in contact with the stopper 3, and the sheet P is nipped by the lateral registration rollers 2, the stopper 3 and the feeding rollers 4 are both released. The lateral registration rollers 2 move in the lateral direction according to the output of the detection sensor 5 while conveying the sheet 9, thereby performing the lateral registration of the sheet P. The speed of the lateral movement of the lateral registration rollers 2 is set so that the lateral registration is finished before the leading end of the sheet P reaches the secondary transfer unit 105. When the leading end of the sheet P is nipped by the secondary transfer unit 105, the lateral registration rollers 2 are released.

The sheet P onto which the image is transferred from the transfer belt 104 is conveyed to the fixing unit 107 by the conveying unit 106, and is discharged out of the image forming apparatus after fixing.

The curved sheet-conveying path 8 is explained. With the radius of curvature of the curved sheet-conveying path 8 set to 50 millimeters or larger, the resistance between the sheet 9 and the curved sheet-conveying path 8 while conveying is reduced. Consequently, when the sheet 9 is conveyed to the sheet aligning unit 1 for aligning the conveying position of the sheet 9 by the lateral registration rollers 2 via the curved sheet-conveying path 8, even if the sheet 9 has a length longer than the distance between the stopper 3 and the sheet-conveying-path junction point A, a large thickness, and a high stiffness, i.e., has a large resistance in conveying, the resistance exerted on the trailing end of the sheet 9 can be suppressed. Therefore, variation in accuracy of aligning a sheet in conveying due to the difference in length, thickness, and stiffness of the sheet 9 can be reduced, enabling to obtain high accuracy of aligning a sheet in conveying for various types of sheets.

The present invention is employed as the sheet aligning unit in the sheet conveying device of the image forming apparatus; however, the present invention can be also employed in other devices for preventing skew (skew) or lateral misalignment in conveying the sheet in general printing machines or the like.

According to one aspect of the present invention, time loss in operation time of the members because of the difference in sheet length can be reduced, so that the conveying efficiency can be improved.

According to another aspect of the present invention, classification of the sheet length is simplified to simplify the rotation control of the cam shaft, so that the cost for the control can be reduced.

According to still another aspect of the present invention, the skew correction and the positional misalignment correction in the main scanning direction can be performed efficiently, enabling to convey the sheet stably.

According to still another aspect of the present invention, an image can be transferred on an appropriate position on the sheet, so that failure in appropriately transferring an image onto the sheet can be reduced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A device for conveying a sheet, comprising:

a sheet conveying path along which the sheet is conveyed;

at least one pair of conveying rollers, a pair of feeding rollers, a pair of lateral registration rollers, a stopper unit that stops a leading end of the sheet conveyed along the sheet conveying path to correct a skew of the sheet, and a detecting unit that detects a position of a side edge of the sheet, arranged on the sheet conveying path in order from an upstream of the sheet conveying path;

a cam unit including three cams fixed on a common cam shaft for moving the feeding rollers, the lateral registration rollers, and the stopper unit, respectively; and a control unit that controls rotations of the cams, wherein the control unit corrects a lateral registration of the sheet based on a detection result of the detecting unit while conveying the sheet of which the skew is corrected by the stopper unit, controls the at least one pair of conveying rollers and the pair of feeding rollers not to nip the sheet at least during the lateral registration, and controls the rotations of the cams according to a length of the sheet, wherein the at least one pair of conveying rollers and the pair of feeding rollers are arranged upstream of the pair of lateral registration rollers in the sheet conveying path.

2. The device according to claim 1, wherein the control unit divides sheets into a plurality of groups depending on the length of the sheet, and controls the rotations of the cams such that sheet aligning and conveying is normally performed for a maximum-length of the groups.

3. The device according to claim 1, wherein the control unit controls driving timings and stop timings of the cams.

4. The device according to claim 1, wherein the control unit controls rotation speeds, driving timings, and stop timings of the cams.

5. The apparatus according to claim 1, wherein the controller further controls the pair of lateral registration rollers to nip the sheet at least during the lateral registration.

6. An apparatus for forming an image, comprising:

a sheet conveying device including a sheet conveying path along which the sheet is conveyed;

at least one pair of conveying rollers, a pair of feeding rollers, a pair of lateral registration rollers, a stopper unit that stops a leading end of the sheet conveyed along the sheet conveying path to correct a skew of the sheet, and a detecting unit that detects a position of a side edge of the sheet, arranged on the sheet conveying path in order from an upstream of the sheet conveying path;

a cam unit including three cams fixed on a common cam shaft for moving the feeding rollers, the lateral registration rollers, and the stopper unit, respectively; and a control unit that controls rotations of the cams, wherein the control unit corrects a lateral registration of the sheet based on a detection result of the detecting unit while conveying the sheet of which the skew is corrected by the stopper unit, controls the at least one pair of conveying rollers and the pair of feeding rollers not to nip the sheet at least during the lateral registration, and controls the rotations of the cams according to a length of the sheet, wherein the at least one pair of conveying rollers and the pair of feeding rollers are arranged upstream of the pair of lateral registration rollers in the sheet conveying path.

7. The apparatus according to claim 6, wherein the control unit divides sheets into a plurality of groups depending on the length of the sheet, and controls the rotations of the cams such that sheet aligning and conveying is normally performed for a maximum-length of the groups.

8. The apparatus according to claim 6, wherein the control unit controls driving timings and stop timings of the cams.

9. The apparatus according to claim 6, wherein the control unit controls rotation speeds, driving timings, and stop timings of the cams.

10. The apparatus according to claim 6, wherein the controller further controls the pair of lateral registration rollers to nip the sheet at least during the lateral registration.

* * * * *